US007986907B2

(12) United States Patent
Miyadera

(10) Patent No.: US 7,986,907 B2
(45) Date of Patent: Jul. 26, 2011

(54) POSITIONAL MISALIGNMENT CORRECTING DEVICE AND IMAGE FORMING APPARATUS

(75) Inventor: Tatsuya Miyadera, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 442 days.

(21) Appl. No.: 12/210,491

(22) Filed: Sep. 15, 2008

(65) Prior Publication Data

US 2009/0074476 A1 Mar. 19, 2009

(30) Foreign Application Priority Data

Sep. 18, 2007 (JP) ..... 2007-240830

(51) Int. Cl.
*G03G 15/00* (2006.01)

(52) U.S. Cl. ..... 399/301; 399/49; 399/72

(58) Field of Classification Search ..... 399/49, 399/72, 301

See application file for complete search history.

(56) References Cited

U.S. PATENT DOCUMENTS

| | | | | |
|---|---|---|---|---|
| 5,523,823 | A * | 6/1996 | Ashikaga | 399/28 |
| 7,647,015 | B2 * | 1/2010 | Kubota et al. | 399/301 |
| 7,715,770 | B2 * | 5/2010 | Kinoshita | 399/301 |
| 2004/0109708 | A1 * | 6/2004 | Kobayashi et al. | 399/301 |
| 2005/0041990 | A1 * | 2/2005 | Sugiyama | 399/49 |
| 2005/0104950 | A1 * | 5/2005 | Eom | 347/116 |
| 2006/0222419 | A1 * | 10/2006 | Ishibashi et al. | 399/301 |
| 2006/0275057 | A1 * | 12/2006 | Suzuki | 399/301 |
| 2008/0038024 | A1 | 2/2008 | Miyadera | |
| 2008/0069602 | A1 | 3/2008 | Miyadera | |
| 2008/0170868 | A1 | 7/2008 | Miyadera | |
| 2008/0212986 | A1 | 9/2008 | Miyadera | |

FOREIGN PATENT DOCUMENTS

| | | |
|---|---|---|
| JP | 2002-236402 | 8/2002 |
| JP | 2005-031227 | 2/2005 |
| JP | 2007-3986 | 1/2007 |

* cited by examiner

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

A positional misalignment correcting device includes a pattern forming unit that forms a correction pattern and a detecting unit that detects the correction pattern. The detecting unit includes one light emitting element and one light receiving element. The pattern forming unit forms the correction pattern on a transfer member such that a formation area in which the correction pattern is to be formed along a direction perpendicular to a conveying direction of the transfer member is smaller than a light-receiving area of the light receiving element.

13 Claims, 12 Drawing Sheets

POSITIONAL MISALIGNMENT CORRECTING DEVICE AND IMAGE FORMING APPARATUS

CROSS-REFERENCE TO RELATED APPLICATIONS

The present application claims priority to and incorporates by reference the entire contents of Japanese priority document 2007-240830 filed in Japan on Sep. 18, 2007.

BACKGROUND OF THE INVENTION

1. Field of the Invention

The present invention relates to a technology for correcting positional misalignment between images in different colors in an image forming apparatus.

2. Description of the Related Art

In tandem-type image forming apparatuses, such as color copiers and color laser printers, image forming processing is performed such that toner images are formed using toners that are developing agents in four colors of yellow, cyan, magenta, and black, and the toner images are sequentially superimposed one on top of the other onto a transfer member (a transfer belt or a transfer paper). Because the toner images are sequentially superimposed, relative positions of the toner images may be misaligned, which leads to color shift. The color shift significantly degrades quality of a color image formed by superimposing the toner images onto the transfer paper. Therefore, it is necessary to suppress color shift (positional misalignment) in the image forming apparatuses.

For example, Japanese Patent Application Laid-open No. 2005-31227 discloses a conventional positional misalignment correcting device that corrects positional misalignment by optically reading a positional misalignment correction pattern formed of a plurality of patches. The positional misalignment correction pattern is formed on an intermediate transfer member such that a reference color pattern and a target color pattern to be corrected (correction toner image) are overlapped with each other. The positional misalignment correcting device includes a detecting unit and a correcting unit. The detecting unit detects specular reflection components, diffused reflection components, or both when a reflective photosensor optically reads the positional misalignment correction pattern. The correcting unit corrects the positional misalignment based on the detected specular reflection components, diffused reflection components, or both. The positional misalignment correcting device sets gloss level of the intermediate transfer member based on an output of the specular reflection components and sets luminosity based on an output of the diffused reflection components outputted when the reflective photosensor optically reads the positional misalignment correction pattern.

Furthermore, Japanese Patent Application Laid-open No. 2002-236402 discloses an image forming method and an image forming apparatus in which a color toner reference image (correction toner image) is formed on an image carrier or a transfer member carrier. A diffused reflection-type concentration detecting unit and a specular reflection-type concentration detecting unit detect reflected light from the reference image. An output value from the diffused reflection-type concentration detecting unit is corrected based on an output value from the specular reflection-type concentration detecting unit and the output value from the diffused reflection-type concentration detecting unit at the time of detection.

In the conventional technologies as described above, the correction toner image is detected by a detector including two light-receiving elements for receiving the specular reflection components and for receiving the diffused reflection components while including a single light-emitting element. When a detector is provided with only one light-receiving element, size and cost of the detector can be reduced as a result of the correction toner image being detected based only on the specular reflection components received by the single light-receiving element.

When the detector is disposed such that an optical axis of the light-emitting element and an optical axis of the light-receiving element on a plane parallel to a normal line direction of the transfer member intersect on a front surface of the transfer member, and an angle formed by the optical axis of the light-emitting element and a normal line of the transfer member and an angle formed by the optical axis of the light-receiving element and the normal line match, a large portion of the reflected light received by the light-receiving element is the specular reflection components. Therefore, effects of the diffused reflection components can be substantially ignored. However, when the optical axis of the light-emitting element and the optical axis of the light-receiving element become misaligned as a result of manufacturing variations in the detector and the like, the effects of the diffused reflection components within the reflected light received by the light-receiving element cannot be ignored. Therefore, detection precision of the detector may decrease.

SUMMARY OF THE INVENTION

It is an object of the present invention to at least partially solve the problems in the conventional technology.

According to an aspect of the present invention, there is provided a positional misalignment correcting device for use in an image forming apparatus. The positional misalignment correcting device includes a pattern forming unit that causes the image forming apparatus to form a plurality of correction patterns on a transfer member along a conveying direction of the transfer member; a detecting unit that optically detects the correction patterns on the transfer member, wherein the detecting unit includes one light emitting element and one light receiving element, the light emitting element irradiating an irradiation area on the transfer member with a light, and the light receiving element receiving a reflection light from a light-receiving area on the transfer member; and a correcting unit that corrects positional misalignment between the correction patterns by controlling an exposing unit of the image forming apparatus based on relative positions of the correction patterns detected by the detecting unit, wherein the pattern forming unit causes the image forming unit to form a first correction pattern on the transfer member along the conveying direction, the detecting unit optically detects the first correction pattern on the transfer member, the pattern forming unit determines a position of the first correction pattern in a first direction perpendicular to the conveying direction based on a detection result from the detecting unit, and based on the position of the first correction pattern, causes the image forming apparatus to form a second correction pattern downstream of the first correction pattern on the transfer member such that a first formation area in which the second correction pattern is to be formed along the first direction is smaller than the light-receiving area.

According to another aspect of the present invention, there is provided an image forming apparatus that includes a plurality of image carriers disposed in a row along a conveying direction of a transfer medium; an exposing unit that forms electrostatic latent images on each of the image carriers by exposing; a plurality of developing units that develop the electrostatic latent images using developing agent to form developed images; a conveying unit that conveys the transfer member; a plurality of transferring units that transfer the developed images onto the transfer member; and a positional misalignment correcting device including a pattern forming unit that causes the image forming apparatus to form a plurality of correction patterns on the transfer member along the conveying direction; a detecting unit that optically detects the correction patterns on the transfer member, wherein the detecting unit includes one light emitting element and one light receiving element, the light emitting element irradiating an irradiation area on the transfer member with a light, and the light receiving element receiving a reflection light from a light-receiving area on the transfer member; and a correcting unit that corrects positional misalignment between the correction patterns by controlling an exposing unit of the image forming apparatus based on relative positions of the correction patterns detected by the detecting unit, wherein the pattern forming unit causes the image forming unit to form a first correction pattern on the transfer member along the conveying direction, the detecting unit optically detects the first correction pattern on the transfer member, the pattern forming unit determines a position of the first correction pattern in a first direction perpendicular to the conveying direction based on a detection result from the detecting unit, and based on the position of the first correction pattern, causes the image forming apparatus to form a second correction pattern downstream of the first correction pattern on the transfer member such that a first formation area in which the second correction pattern is to be formed along the first direction is smaller than the light-receiving area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. According to an embodiment, technical ideas of the present invention are applied to an image forming apparatus and a positional misalignment correcting device in a tandem-type color laser beam printer. However, the present invention can be applied to various image forming apparatuses and positional misalignment correcting devices that use electrostatic photography, such as color copiers and facsimile machines.

Figure 2:
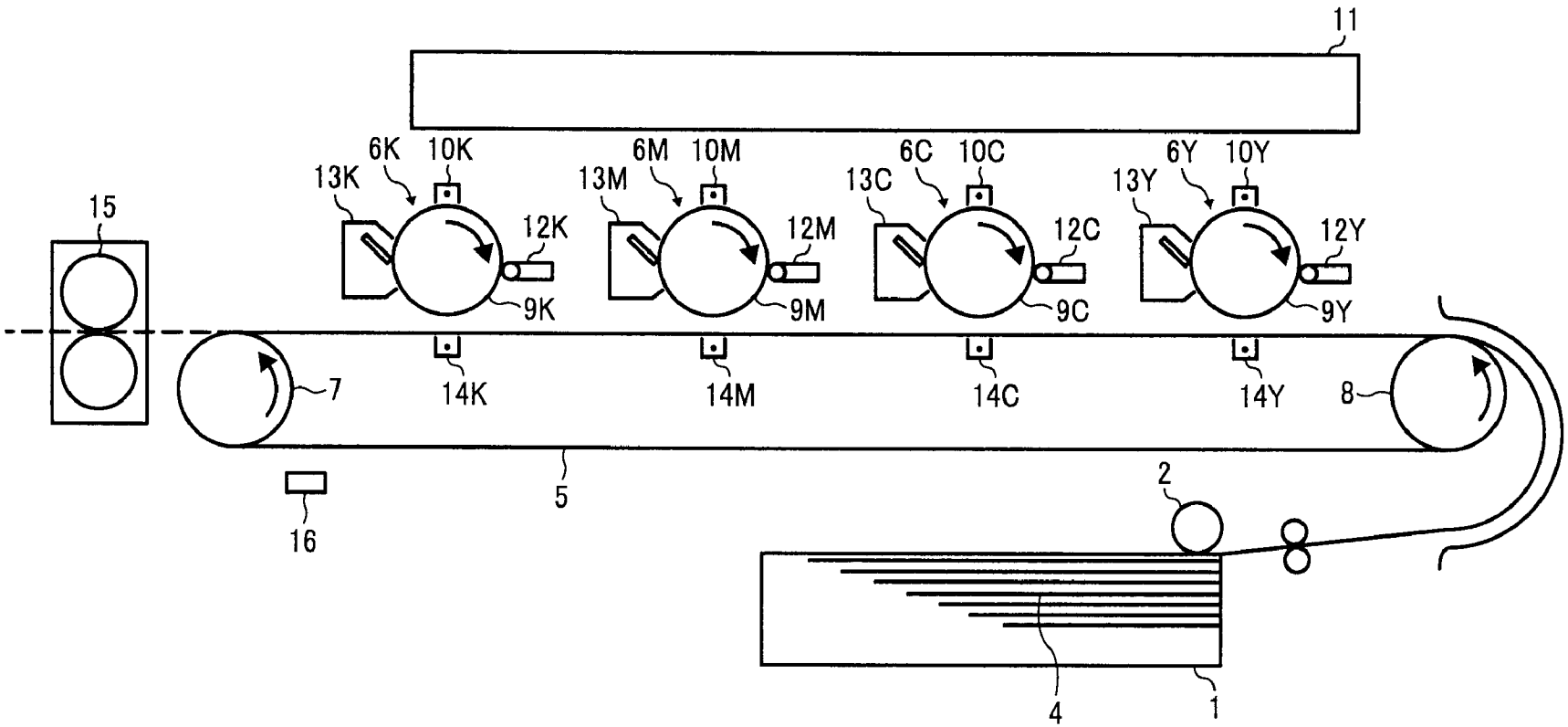
FIG. 2 is a schematic diagram of main components of an image forming apparatus according to the embodiment.
Figure 3:
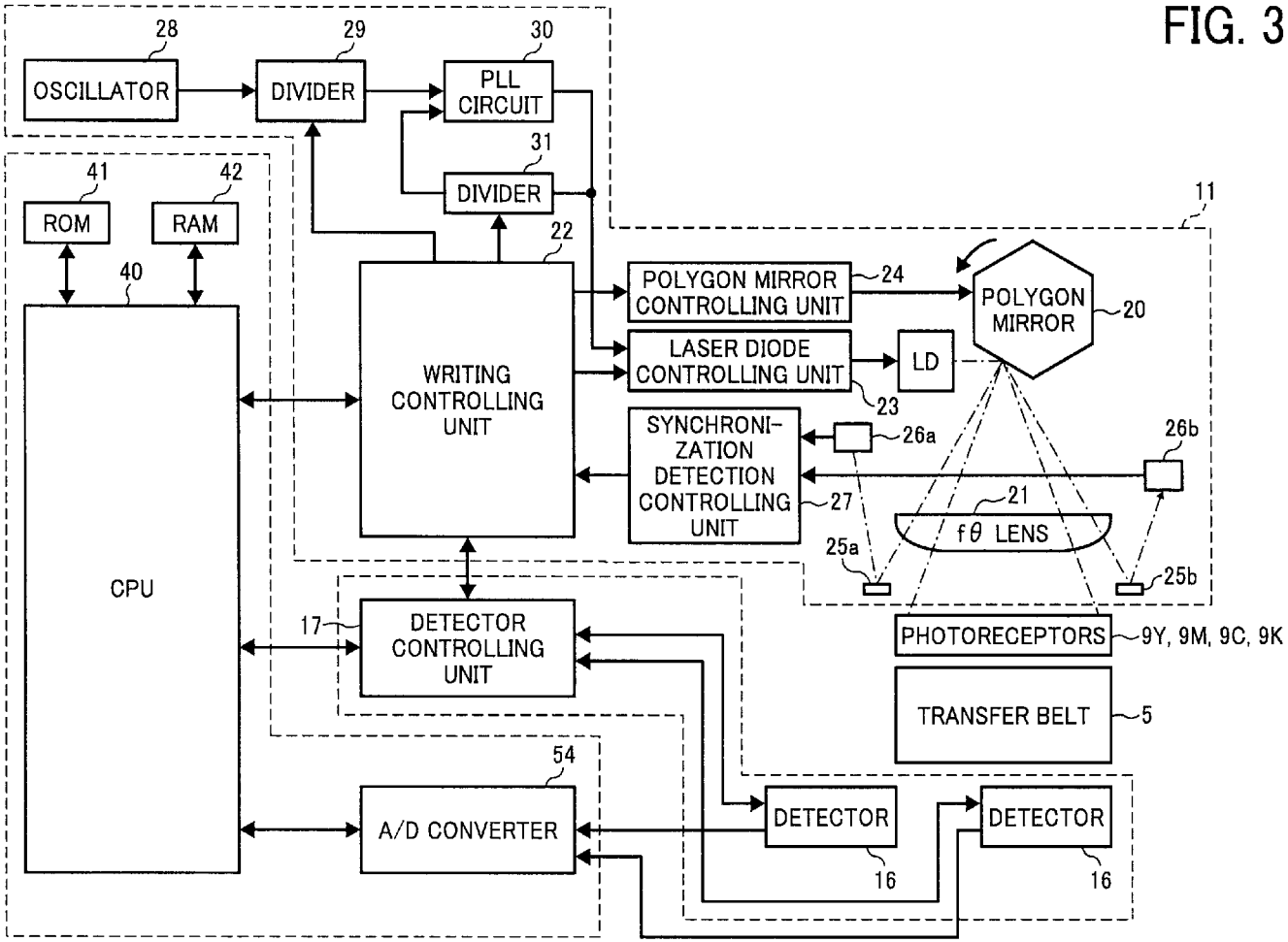
FIG. 3 is a block diagram of the main components shown in FIG. 2.

FIG. 2 is a schematic diagram of main components of the image forming apparatus according to the embodiment. FIG. 3 is a block diagram of the main components shown in FIG. 2.

Four image processing units 6Y, 6C, 6M, and 6K are aligned along a transfer belt 5 that conveys a transfer paper 4 serving as a transfer member. Each of the image processing units 6Y, 6C, 6M, and 6K forms an image (toner image) in each different color (yellow (Y), cyan (C), magenta (M), and black (K)). The transfer belt 5 is extended between a driving roller 8 and a driven roller 7. The driving roller 8 is driven to rotate by a motor (not shown). The driven roller 7 rotates with a rotation of the driving roller 8. The transfer belt 5 rotates in a direction of an arrow in FIG. 2 with the rotation of the driving roller 8. A paper feeding tray 1 storing therein the transfer papers 4 is provided below the transfer belt 5. An uppermost sheet of the transfer papers 4 stored in the paper feeding tray 1 is fed towards the transfer belt 5 by a paper feeding roller 2 during image formation. The transfer paper 4 is then attached to the transfer belt 5 by electrostatic attachment. The attached transfer paper 4 is conveyed to the image processing unit 6Y, and an image is formed on the transfer paper 4 using yellow toner. Each of the image processing units 6Y, 6C, 6M, and 6K includes a photoreceptor 9Y, 9C, 9M, or 9K, a charger 10Y, 10C, 10M, or 10K, an exposure device 11, a developer 12Y, 12C, 12M, or 12K, and a photoreceptor cleaner 13Y, 13C, 13M, or 13K. The chargers 10Y, 10C, 10M, and 10K, the exposure device 11, the developers 12Y, 12C, 12M, and 12K, and the photoreceptor cleaners 13Y, 13C, 13M, and 13K are disposed near the photoreceptors 9Y, 9C, 9M, and 9K, respectively. The photoreceptors 9Y, 9C, 9M, and 9K have cylindrical shapes and serve as image carriers. The exposure device 11 is shared by the image processing units 6Y, 6C, 6M, and 6K.

Figure 4:
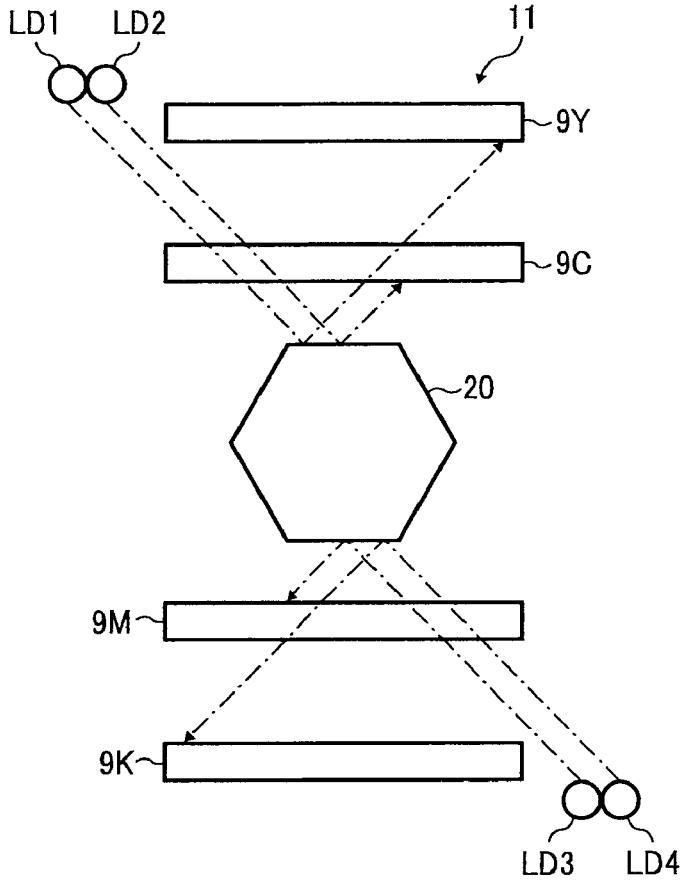
FIG. 4 is a schematic diagram of an exposure device shown in FIG. 3.

FIG. 3 is a block diagram of the main components shown in FIG. 2. FIG. 4 is a schematic diagram of the exposure device 11. As shown in FIG. 4, the exposure device 11 includes a laser light source LD, a polygon mirror 20, and an optical system, such as an fθ lens 21. The laser light source LD includes a light source LD1 for the photoreceptor 9Y, a light source LD2 for the photoreceptor 9C, a light source LD3 for the photoreceptor 9M, and a light source LD4 for the photoreceptor 9K. The polygon mirror 20 has a plurality of reflective surfaces that reflect laser lights emitted from the light sources LD1, LD2, LD3, and LD4. The optical system focuses reflected lights reflected by the polygon mirror 20 onto front surfaces of the photoreceptors 9Y, 9C, 9M, and 9K. The exposure device 11 exposes the front surfaces of the photoreceptors 9Y, 9C, 9M, and 9K along an axial direction by rotating the polygon mirror 20 and along a circumferential direction (a conveying direction of the transfer paper 4) by rotating the photoreceptors 9Y, 9C, 9M, and 9K around an axis. In the exposure device 11, a laser light emitted from the laser light source LD1 to expose the photoreceptor 9Y and a laser light emitted from the laser light source LD2 to expose the photoreceptor 9C are simultaneously reflected by one reflective surface of the polygon mirror 20. Similarly, a laser light emitted from the laser light source LD3 to expose the photoreceptor 9M and a laser light emitted from the laser light source LD4 to expose the photoreceptor 9K are simultaneously reflected by another reflective surface (a reflective surface directly opposite to the one reflective surface reflecting the laser lights from the light sources LD1 and LD2) of the polygon mirror 20.

When a color image is formed, a CPU 40 performs a color conversion process in advance on a color separation image signal provided by a color image reading apparatus, a printer driver of a personal computer, and the like, based on an intensity level of the color separation image signal. The color separation image signal is converted into black (B) color image data, magenta (M) color image data, yellow (Y) color image data, and cyan (C) color image data. The pieces of color image data are outputted to a writing controlling unit 22 of the exposure device 11.

When an image formation operation starts, first, the front surfaces of the photoreceptors 9Y, 9C, 9M, and 9K are uniformly charged in a dark environment by the chargers 10Y, 10C, 10M, and 10K, respectively. Modulated laser beams are then emitted from the laser light sources LD1, LD2, LD3, and LD4 by a laser diode controlling unit 23, based on the color image data for each color received by the writing controlling unit 22 from the CPU 40. A polygon mirror controlling unit 24 rotates the polygon mirror 20. As a result, the front surfaces of the photoreceptors 9Y, 9C, 9M, and 9K are exposed to patterns corresponding to the color image data, forming electrostatic latent images. Main scanning with laser beams by the polygon mirror 20 and sub-scanning with the laser beams in the conveying direction of the transfer paper 4 are synchronized as follows. The laser beams pass through the fθ lens 21 and are reflected by a reflecting mirror 25*a* and a reflecting mirror 25*b*. A light-receiving element 26*a* and a light-receiving element 26*b* detect reflected lights from the reflecting mirrors 25*a* and 25*b*. The light-receiving elements 26*a* and 26*b* are, for example, photodiodes. A synchronization detection controlling unit 27 outputs a synchronization signal to the writing controlling unit 22 based on outputs from the light-receiving elements 26*a* and 26*b*. The exposure device 11 also includes a known clock generator. The clock generator includes an oscillator 28 that generates a reference clock signal, a divider 29 that divides a reference clock outputted from the oscillator 28 by 1/M, a phase locked loop (PLL) circuit 30, and a divider 31 that divides an output signal from the PLL circuit 30 by 1/N. The writing controlling unit 22 arbitrarily sets divisors M and N of the dividers 29 and 31. A reference clock frequency is divided by a divisor N÷/M, and the clock generator outputs the divided frequency to the laser diode controlling unit 23. Therefore, the laser diode controlling unit 23 can adjust a timing at which the laser light sources LD1 to LD4 emit lights based on the divisors M and N set by the writing controlling unit 22.

The developers 12Y, 12C, 12M, and 12K develop electrostatic latent images formed on the photoreceptors 9Y, 9C, 9M, and 9K, respectively. As a result, toner images are formed in each color. Each of the toner images is transferred onto the transfer paper 4 in an overlapping manner at a transfer position of each color, resulting in forming a full-color image. The transfer position of each color is a nip between the photoreceptor 9Y and a transfer device 14Y, the photoreceptor 9C and a transfer device 14C, the photoreceptor 9M and a transfer device 14M, and the photoreceptor 9K and a transfer device 14K. After the toner images are transferred, the transfer paper 4 is separated from the transfer belt 5 and sent to a fixing device 15. The fixing device 15 fixes the color image onto the transfer paper 4. The transfer paper 4 is then ejected by a paper ejecting unit (not shown). After the toner images are transferred onto the transfer paper 4, the photoreceptor cleaners 13Y, 13C, 13M, and 13K remove toners remaining on the photoreceptors 9Y, 9C, 9M, and 9K, respectively. As a result, the photoreceptors 9Y, 9M, 9C, and 9K are made ready for a next image formation operation.

Positioning of the toner images to be superimposed onto the transfer paper 4 is controlled by setting an exposure-start timing for starting exposure by the exposure device 11 such that a timing at which the transfer paper 4 is conveyed to the transfer position and a timing at which the toner images on the photoreceptors 9Y, 9C, 9M, and 9K are moved to the transfer position match for each of the toner images.

However, positional misalignment may occur among the toner images in each color as a result of superimposing the toner images at positions shifted from desired positions. The positional misalignment may occur because of an error in inter-axial distances among the photoreceptors 9Y, 9C, 9M, and 9K, an error in a degree of parallelization among the photoreceptors 9Y, 9C, 9M, and 9K, an error in placement of the optical system such as the reflecting mirrors 25*a* and 25*b*, an error in writing timing, and the like. Even when adjustments are initially made, errors occur as a result of replacement of image forming units including the photoreceptors 9Y, 9C, 9M, and 9K and the developers 12Y, 12C, 12M, and 12K with new ones, maintenance, product shipping, and the like. Moreover, errors vary with time as a result of temperature expansion occurring in mechanisms after images are formed on a plurality of sheets of paper. Therefore, adjustments are required to be made more frequently.

Five types of positional misalignment (color shifts) are conventionally known to occur among the toner images in each color as a result of the above-described errors (refer to, for example, Japanese Patent Application Laid-open No. H11-65208 and Japanese Patent Application Laid-open No. 2002-244393).

The five types of positional misalignment are skewing, registration error in the sub-scanning direction, pitch variation in the sub-scanning direction, registration error in the main-scanning direction, and scaling error in the main-scanning direction.

Figure 6:
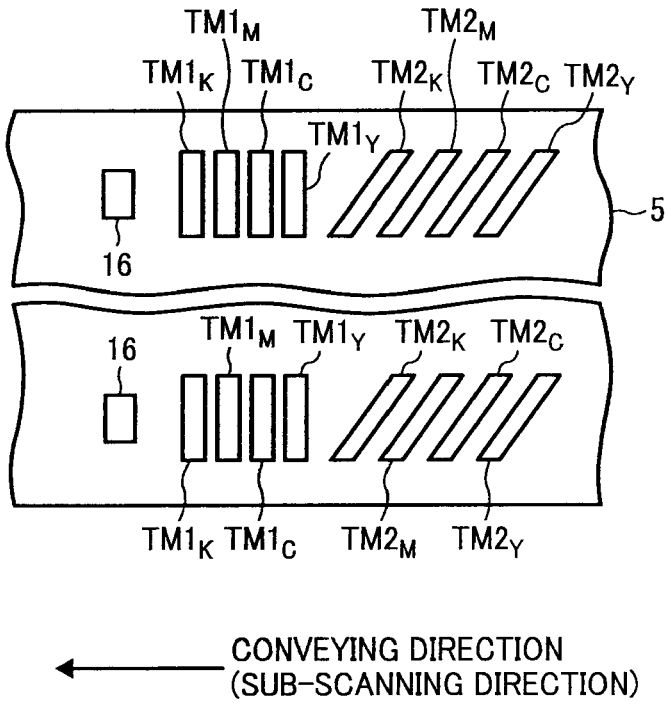
FIG. 6 is a schematic diagram of correction toner images formed on a transfer belt shown in FIG. 2.

Like conventional examples described in the Japanese Patent Applications mentioned above, the image forming apparatus according to the embodiment corrects positional misalignment (color shift) for each color before actually forming the color image on the transfer paper 4. Specifically, a positional misalignment correction pattern, such as that shown in FIG. 6, is formed on the transfer belt 5. The positional misalignment correction pattern includes a correction toner image $TMn_Y$, a correction toner image $TMn_C$, a correction toner image $TMn_M$, and a correction toner image $TMn_K$ of each color (n=1 or 2). A detecting unit, which will be described later, detects the correction toner images $TMn_Y$, $TMn_C$, $TMn_M$, and $TMn_K$ of the positional misalignment correction pattern. The CPU 40 determines a positional misalignment amount occurring among the toner images of each color using a detection result from the detecting unit. The exposure device 11 changes a setting of the exposure-start timing. Here, the positional misalignment correction pattern includes strip-shaped images having straight lines parallel to the main-scanning direction, which are a first correction toner image $TM1_Y$, a first correction toner image $TM1_C$, a first correction toner image $TM1_M$, and a first correction toner image $TM1_K$, and strip-shaped images having straight lines respectively intersecting with the main-scanning direction and the sub-scanning direction at a 45-degree angle, which are a second correction toner image $TM2_Y$, a second correction toner image $TM2_C$, a second correction toner image $TM2_M$, and a second correction toner image $TM2_K$. The first correction toner images $TM1_Y$, $TM1_C$, $TM1_M$, and $TM1_K$, and the second correction toner images $TM2_Y$, $TM2_C$, $TM2_M$, and $TM2_K$ are aligned in the sub-scanning direction with a predetermined distance therebetween (see FIG. 6).

Figure 5:
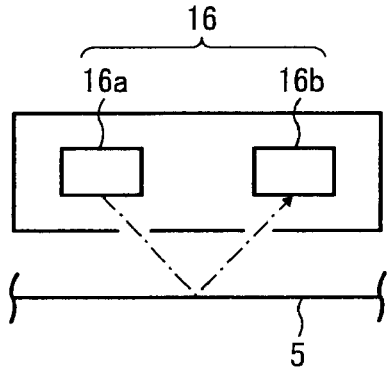
FIG. 5 is a schematic diagram of a detector shown in FIG. 3.

The detecting unit includes three detectors 16 (only two detectors are shown in FIG. 3) and a detector controlling unit 17 (see FIG. 3). The detectors 16 are provided facing the transfer belt 5 at both ends and a center in the main-scanning direction. The detector controlling unit 17 controls the three detectors 16. As shown in FIG. 5, the detector 16 includes a light-emitting element 16*a* and a light-receiving element 16*b* that are disposed facing the transfer belt 5. A light emitted from the light-emitting element 16*a* controlled by the detector controlling unit 17 is reflected by a front surface of the transfer belt 5 having a higher reflectance than each color toner. The reflected light is then received by the light-receiving element 16*b*. An analog-to-digital (A/D) converter 54 performs A/D conversion on a detection signal having a level corresponding to an amount of light received by the light-receiving element 16*b*. The A/D converter 54 inputs the converted detection signal into the CPU 40. In other words, timings at which the correction toner images $TMn_Y$, $TMn_C$, $TMn_M$, and $TMn_K$ pass the detectors 16 can be detected based on a fact that the amount of light received by the light-receiving element 16*b* decreases by an amount of decrease of reflected light due to the correction toner images $TMn_Y$, $TMn_C$, $TMn_M$, and $TMn_K$.

A positional misalignment correcting device of the present embodiment includes the above-described detecting unit, the CPU 40, a ROM 41, a RAM 42, and the like (see FIG. 3). The ROM 41 stores therein computer programs for a positional misalignment correction process and computer programs for other processes. The RAM 42 provides a working area required when the CPU 40 executes the computer programs. Positional misalignment correction is performed by the CPU 40 executing the computer program for the positional misalignment correction process stored in the ROM 41.

Figure 8A:
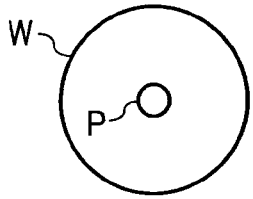
FIGS. 8A and 8B are schematic diagrams for explaining spot misalignment occurring in the image forming apparatus shown in FIG. 2.
Figure 8B:
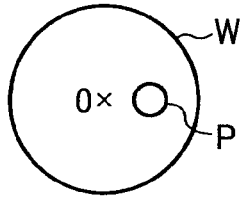

The detector 16 is preferably provided such that an optical axis of the light-emitting element 16*a* and an optical axis of the light-receiving element 16*b* on a plane parallel to a normal line direction of the transfer belt 5 intersect on the front surface of the transfer belt 5. In addition, an angle formed by the optical axis of the light-emitting element 16*a* and the normal line of the transfer belt 5 and an angle formed by the optical axis of the light-receiving element 16*b* and the normal line match. The detector 16 outputs a signal having a voltage level that is almost proportionate to the amount of light received by the light-receiving element 16*b*. Here, when the detectors 16 are configured and disposed as planned, and the optical axes of the light-emitting element 16*a* and the light-receiving element 16*b* of each of the detectors 16 meet the above-described conditions, as shown in FIG. 8A, the light-receiving element 16*b* receives a light (specular reflected light component) directly reflected from an irradiation area P (an area in which the light emitted from the light-emitting element 16*a* is irradiated on the transfer belt 5) at a center of a light-receiving area W (an area from which the light-receiving elements 16*b* simultaneously receive lights) of the light-receiving element 16*b*. However, when the detectors 16 are not configured and disposed as planned, and the optical axes of the light-emitting element 16*a* and the light-receiving element 16*b* of each of the detectors 16 do not meet the above-described conditions because of manufacturing variations and the like, as shown in FIG. 8B, a center O of the light-receiving area W of the light-receiving element 16*b* and the irradiation area P of the light-emitting element 16*a* become misaligned.

Figure 7A:
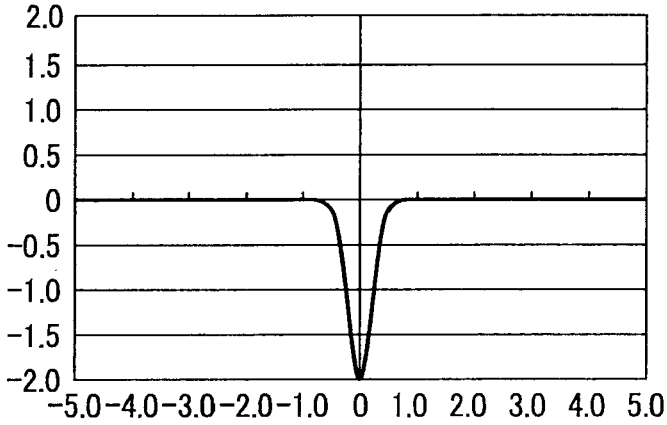
FIGS. 7A to 7F are graphs for explaining detection signals used in the image forming apparatus shown in FIG. 2.
Figure 7B:
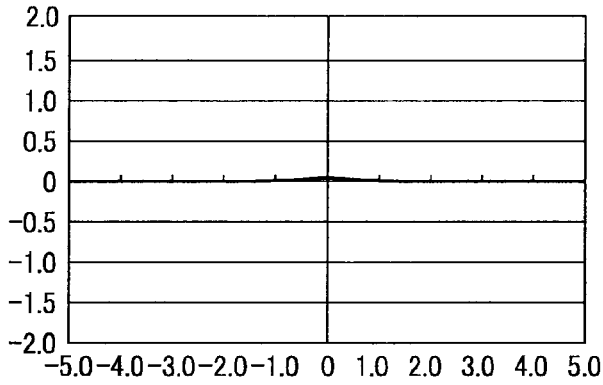
Figure 7C:
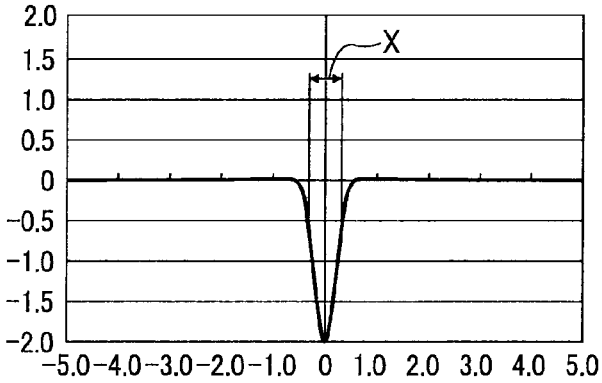
Figure 7D:
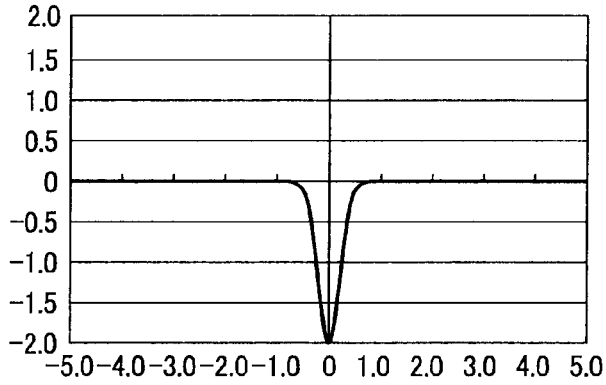
Figure 7E:
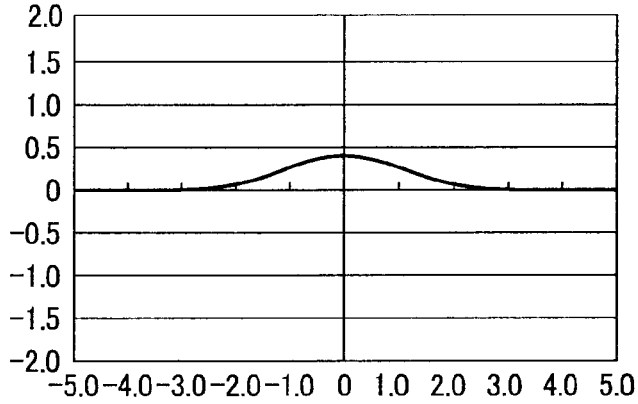
Figure 7F:
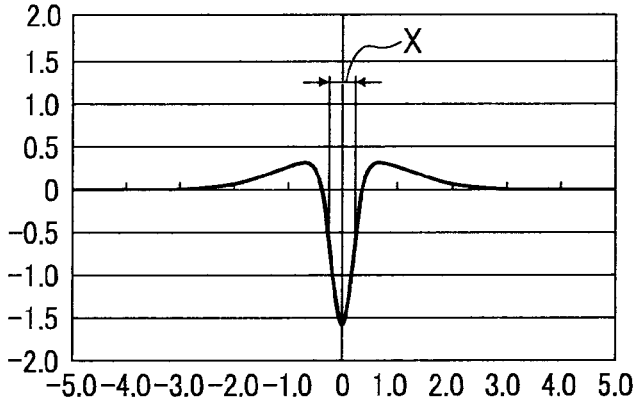

Because the toners have a lower reflectance than the front surface of the transfer belt 5, compared to when only reflected lights reflected by the front surface of the transfer belt 5 enters the light-receiving element 16*b*, the level of the detection signal outputted from the detector 16 decreases as a percentage of reflected lights reflected by the front surface decreases and a percentage of reflected lights reflected by the toner surface increases with the rotation of the transfer belt 5. FIGS. 7C and 7F are graphs of waveforms of the detection signal. A vertical axis indicates a value of the detection signal normalized at an output level of when only the reflected light from the front surface of the transfer belt 5 is received. A horizontal axis indicates time normalized at times at which the correction toner images $TMn_Y$, $TMn_C$, $TMn_M$, and $TMn_K$ conveyed with the rotation of the transfer belt 5 arrive at an intersection between the optical axes of the light-emitting element 16*a* and the light-receiving element 16*b*. FIG. 7A is a graph of a detection signal waveform of only the specular reflected light components within the reflected light reflected by the black correction toner image $TMn_K$. FIG. 7B is a graph of a detection signal waveform of only the diffused reflected light components within the reflected light reflected by the black correction toner image $TMn_K$. FIG. 7C is a graph of an actual detection signal waveform of the black correction toner image $TMn_K$ including both the specular reflected light components and the diffused reflected light components. Because toners of a color other than black (yellow, magenta, and cyan) have a relatively higher reflectance than a black toner, the detection signal waveform of only the specular reflected light components and the detection signal waveform of only the diffused reflected light components in the reflected light reflected by the correction toner images $TMn_Y$, $TMn_C$, and $TMn_M$ for colors other than black, and an actual detection signal waveform including both components have relatively large absolute values, as shown respectively in FIGS. 7D, 7E, and 7F.

Because the level of the detection signal is lowest when centers of the correction toner images $TMn_Y$, $TMn_C$, $TMn_M$, and $TMn_K$ moving in the sub-scanning direction pass through the intersection between the optical axes of the light-emitting element 16*a* and the light-receiving element 16*b* (see FIGS. 7C and 7F), the correction toner images $TMn_Y$, $TMn_C$, $TMn_M$, and $TMn_K$ can be detected through detection of a peak in the detection signal on a negative side (a first area). Specifically, the correction toner images $TMn_Y$, $TMn_C$, $TMn_M$, and $TMn_K$ are detected through a comparison of the level of the detection signal with a threshold set on the negative side ("−0.5" in FIGS. 7C and 7F). A center of a segment X (between both ends of a correction toner image in a width direction) at which the level is less than the threshold is considered to be the peak in the detection signal on the negative side (a first peak). According to the embodiment, the CPU 40 performs a process for detecting the correction toner images $TMn_Y$, $TMn_C$, $TMn_M$, and $TMn_K$. The CPU 40 also uses the A/D converter 54 to convert analog output signals outputted from the two detectors 16 to digital signals.

The CPU 40 determines a positional misalignment amount for each of the above-described five types of positional misalignment based on a relative difference (time difference) between a detection position of the black correction toner image $TMn_K$ detected by the detector 16 and detection positions of the correction toner images in the other colors (the yellow correction toner image $TMn_Y$, the cyan correction toner image $TMn_C$, and the magenta correction toner image $TMn_M$). The CPU 40 also determines positional misalignment amounts based on a design value of a conveying speed of the transfer belt 5. The CPU 40 performs correction operations such as those described below (refer to Japanese Patent Application Laid-open No. 2002-244393) to eliminate the determined positional misalignment amounts. Methods of calculating each positional misalignment amount are conventionally known as described in, for example, Japanese Patent Application Laid-open No. H11-65208, and therefore, detailed explanations are omitted.

First, a correction operation for skew misalignment is described below. The skew misalignment is corrected by changing angles of the reflecting mirrors 25*a* and 25*b* in the exposure device 11. The angles of the reflecting mirrors 25*a* and 25*b* are changed by driving a mechanism that can adjust the angles of the reflecting mirrors 25*a* and 25*b* by a stepping motor (not shown).

The registration error in the sub-scanning direction, the registration error in the main-scanning direction, and the pitch variation in the sub-scanning direction are corrected by the CPU 40 that causes the writing controlling unit 22 to adjust a timing (writing timing) at which the laser diode controlling unit 23 causes the laser light sources LD to emit the laser beams, based on each positional misalignment amount with respect to the synchronization signal outputted from the synchronization detection controlling unit 27.

The scaling error in the main-scanning direction is corrected by the CPU 40 that causes the writing controlling unit 22 to adjust the clock signal outputted from the clock generator in the exposure device 11 based on the amount of misalignment caused by the scaling error.

A method of forming the positional misalignment correction pattern of the present invention is described below. FIGS. 9A to 9F are diagrams of detection signal waveforms of the black correction toner image $TMn_K$, and the correction toner images $TMn_Y$, $TMn_C$, and $TMn_M$ in the colors other than black. Similar to those shown in FIGS. 7A to 7F, the vertical axis indicates a value of a detection signal of which a reference level (=0) is at an output level of when only the reflected light from the front surface of the transfer belt 5 is received. The horizontal axis indicates time normalized at times at which the correction toner images $TMn_Y$, $TMn_C$, $TMn_M$, and $TMn_K$ conveyed with the rotation of the transfer belt 5 arrive at the intersection between the optical axes of the light-emitting element 16*a* and the light-receiving element 16*b*.

As described above, the detector 16 includes the light-emitting element 16*a* and the light-receiving element 16*b*. The light emitted from the light-emitting element 16*a* is reflected by the transfer belt 5, and the correction toner images $TMn_Y$, $TMn_C$, $TMn_M$, and $TMn_K$. The reflected light is received by the light-receiving element 16*b*. The correction toner images $TMn_Y$, $TMn_C$, $TMn_M$, and $TMn_K$ are detected based on the peak on the negative side (first peak). However, because of manufacturing variations and the like, the detectors 16 may not be configured and disposed as planned, and the optical axes of the light-emitting element 16*a* and the light-receiving element 16*b* may be misaligned. In this case, as shown in FIG. 8B, a light-receiving position for the specular reflected light components (irradiation area P of the light-emitting element 16*a*) may be misaligned with the center O of the light-receiving area W (hereinafter, "spot misalignment"). When the spot misalignment occurs, the first peak in the detection signal shifts from a timing at which the first peak is intended to be detected (original points of the horizontal axes in FIGS. 9C and 9F).

Figure 9A:
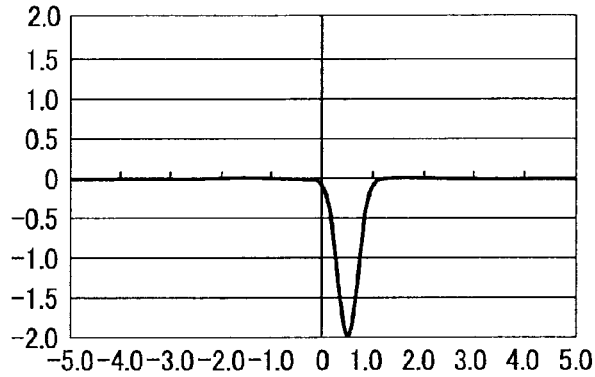
FIGS. 9A to 9F are graphs for explaining detection signals used in the image forming apparatus shown in FIG. 2.
Figure 9B:
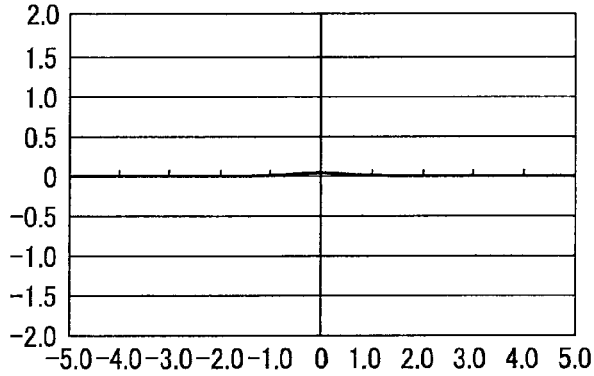
Figure 9C:
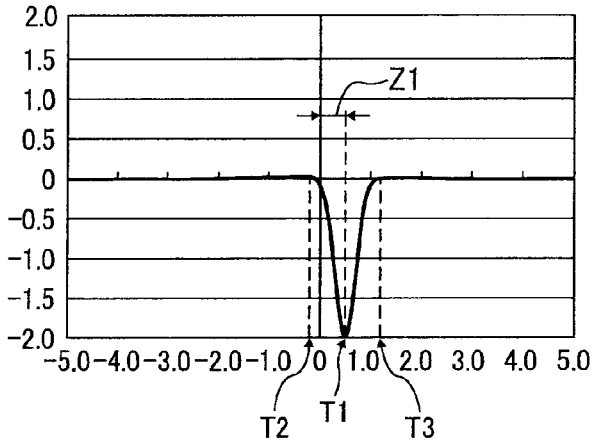
Figure 9D:
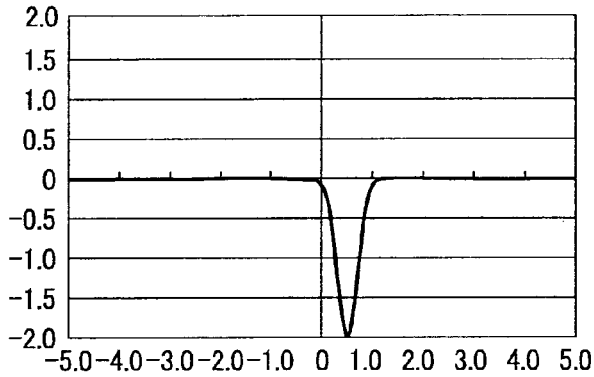
Figure 9E:
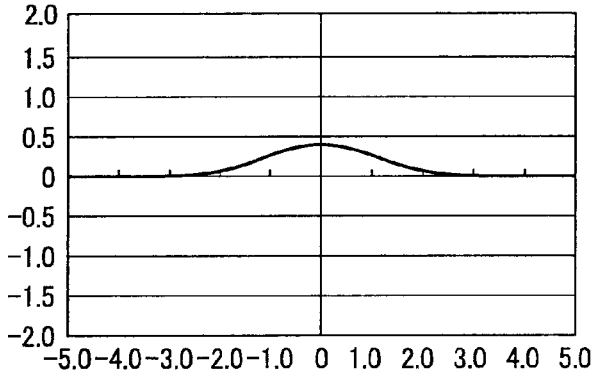
Figure 9F:
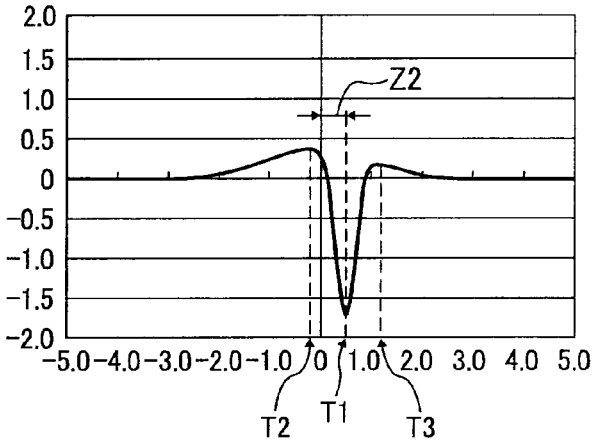

Here, taking the specular reflected light components and the diffused reflected light components in the reflected light received by the light-receiving element 16*b* into consideration separately, as shown in FIGS. 9A and 9D, a peak of the specular reflected light components on the negative side is significantly shifted in the horizontal axis direction (time axis) as a result of spot misalignment. However, as shown in FIGS. 9B and 9E, a peak of the diffused reflected light components on a positive side (second area) is little affected by spot misalignment and is only slightly shifted in the horizontal axis direction (time axis). Therefore, in the actual detection signal in which the specular reflected light components and the diffused reflected light components are combined, differences in an amount of misalignment of the first peak caused by spot misalignment depends on an amount of the diffused reflected light components. When the amount of misalignment is the same in all the correction toner images $TMn_Y$, $TMn_C$, $TMn_M$, and $TMn_K$ of all colors, color shift correction is not impeded. However, in actuality, because the diffused reflected light components differ among the correction toner images $TMn_Y$, $TMn_C$, $TMn_M$, and $TMn_K$, the amounts of misalignment also differ. Therefore, the color shift correction is impeded. As can be seen from comparison between the examples shown in FIGS. 9B and 9E, because the black toner has significantly lower reflectance than the toners in the other colors (yellow, cyan, and magenta), the diffused reflected light components of the toners other than black are greater than the diffused reflected light components of the black toner. Therefore, a significant difference is present between an amount of misalignment Z1 of the first peak of the black correction toner image $TMn_K$ and an amount of misalignment Z2 of the correction toner images $TMn_Y$, $TMn_C$, and $TMn_M$ of the colors other than black (see FIGS. 9C and 9F).

In the positional misalignment correction process described above, the amount of positional misalignment is determined based on a relative difference (time difference) between one correction toner image serving as a reference (the black correction toner image $TMn_K$) and the other toner images for correction (the correction toner images $TMn_Y$, $TMn_C$, and $TMn_M$). Therefore, as described above, when a difference is present between the amount of misalignment of the first peak of the black correction toner image $TMn_K$ as the reference and the amount of misalignment of the first peaks of the correction toner images $TMn_Y$, $TMn_C$, and $TMn_M$ of the colors other than black, and a difference is present in the amount of misalignment of the first peak among the correction toner images $TMn_Y$, $TMn_C$, and $TMn_M$ of the colors other than black, an error occurs in the time difference for determining the amount of positional misalignment. When the amount of positional misalignment is calculated and corrected based on an erroneous time difference, accuracy of the positional misalignment correction decreases.

Figure 10A:
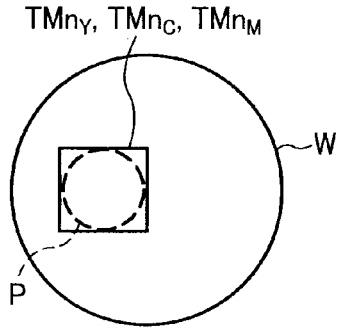
FIG. 10A is a schematic diagram for explaining a relationship between the correction toner image and a light-receiving area of a light-receiving element.
Figure 10B:
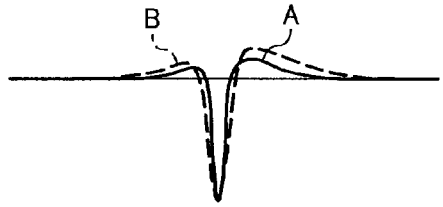
FIG. 10B is a schematic diagram for explaining a detection signal from a detector in the state shown in FIG. 10A.

The detection signal level of the diffused reflected light components on the positive side decreases as an area of the position misalignment correction pattern (the correction toner images $TMn_Y$, $TMn_C$, $TMn_M$, and $TMn_K$) in the light-receiving area of the light-receiving element 16*b* decreases. Therefore, as shown in FIG. 10A, when a formation area of the correction toner images $TMn_Y$, $TMn_C$, and $TMn_M$ is of a size smaller than a size of the light-receiving area W of the light-receiving element 16*b* on the transfer belt 5, as shown by a solid line A in FIG. 10B, the diffused reflected light components decreases compared to the detection signal (broken line B in FIG. 10B) when the size of the formation area of the correction toner images $TMn_Y$, $TMn_C$, and $TMn_M$ is greater than the size of the light-receiving area W. Concretely, detection errors of the correction toner images $TMn_Y$, $TMn_C$, $TMn_M$, and $TMn_K$ of each color can be suppressed. As a result, spot misalignment hardly affects calculation of the positional misalignment amount in the positional misalignment correcting device. Furthermore, the decrease in precision of positional misalignment correction can be prevented. However, when the formation area of the correction toner images $TMn_Y$, $TMn_C$, and $TMn_M$ is to be of a size as described above, the irradiation area P of the light-emitting element 16*a* on the transfer belt 5 in the main-scanning direction needs to be detected in advance. The correction toner images $TMn_Y$, $TMn_C$, and $TMn_M$ are required to be formed at a position overlapping with the irradiation area P of the light-emitting element 16*a* in the main-scanning direction (see FIG. 10A).

Figure 1:
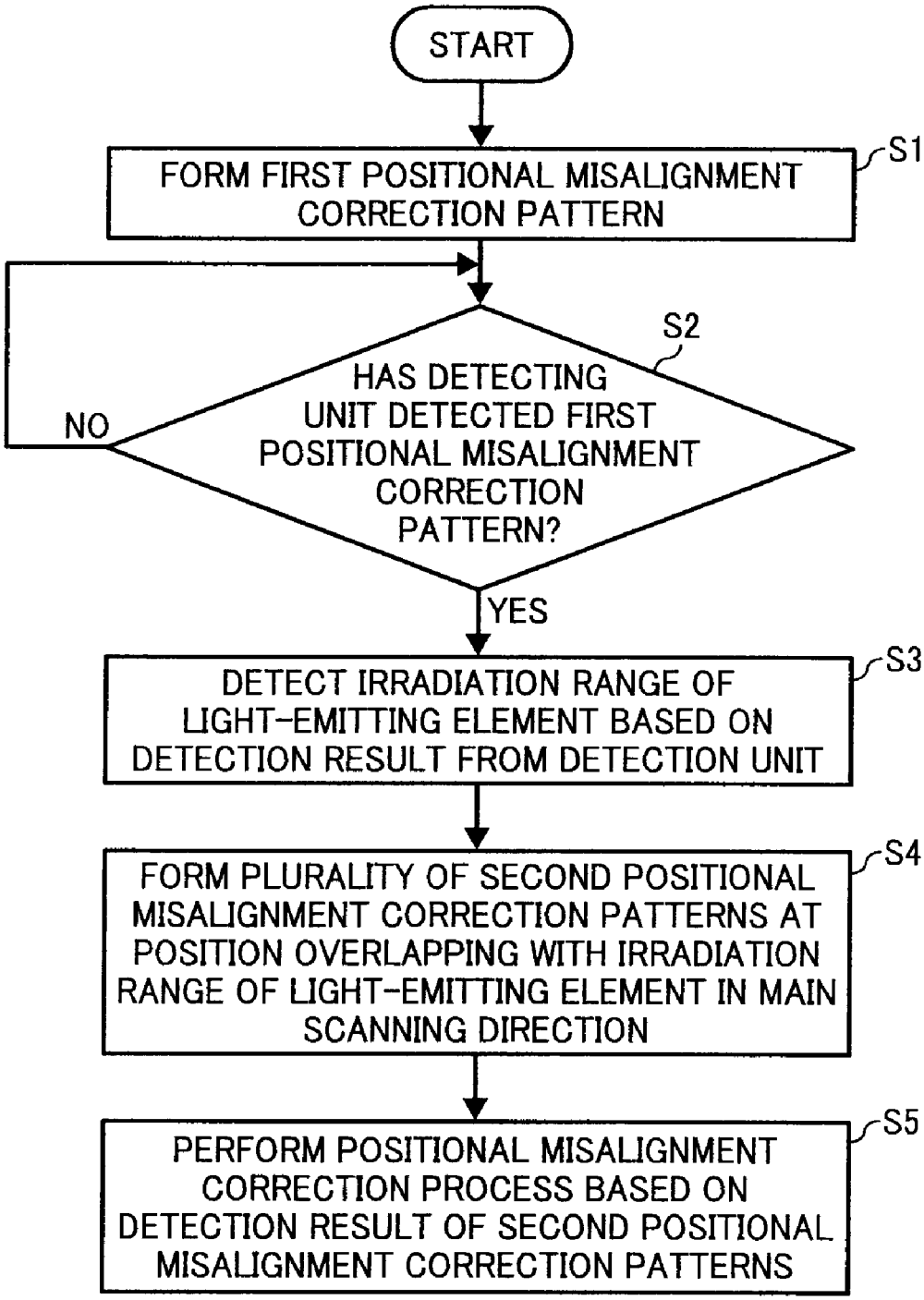
FIG. 1 is a flowchart of a positional misalignment correction process according to an embodiment of the present invention.

A method of detecting the irradiation area P of the light-emitting element 16*a* on the transfer belt 5 in the main-scanning direction in advance and subsequently forming the correction toner images $TMn_Y$, $TMn_C$, and $TMn_M$ at the position overlapping with the irradiation area P is described below with reference to a flowchart in FIG. 1.

Figure 11:
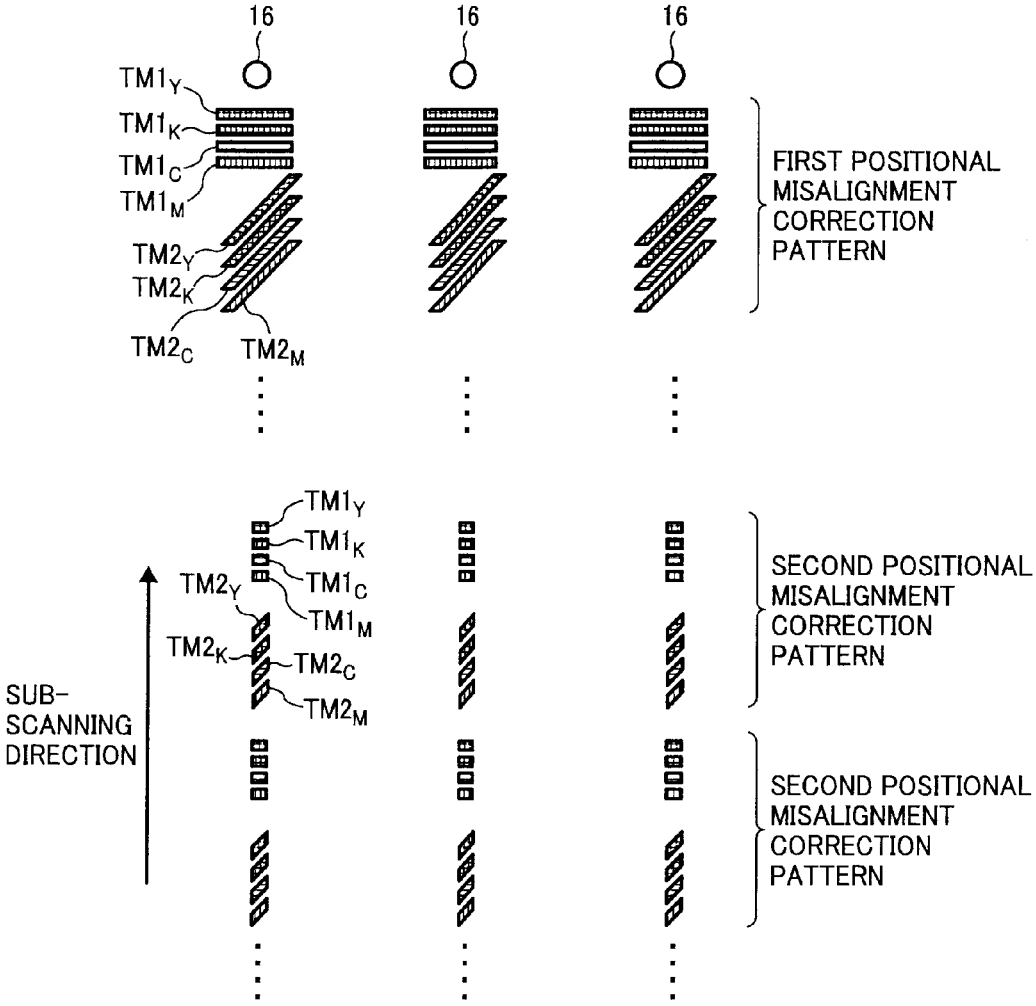
FIG. 11 is a plan view of positional misalignment correction patterns of the correction toner images formed in the image forming apparatus shown in FIG. 2.

The CPU 40 that has started a positional misalignment correction process forms an initial positional misalignment correction pattern (first positional misalignment correction pattern) in which the first correction toner images $TM1_Y$, $TM1_C$, $TM1_M$, and $TM1_K$, and the second correction toner images $TM2_Y$, $TM2_C$, $TM2_M$, and $TM2_K$ form a group (set) (Step S1). At this state, because the first positional misalignment correction pattern is used to detect the irradiation area P in the main-scanning direction, the first positional misalignment correction pattern is formed in an area larger than the light-receiving area W of the light-receiving element 16*b* in the main-scanning direction. When the detecting unit detects the first positional misalignment correction pattern (Yes at Step S2), and a detection result is inputted into the CPU 40, the CPU 40 calculates a difference between a position of the first positional misalignment correction pattern (the correction toner images $TMn_Y$, $TMn_C$, $TMn_M$, and $TMn_K$) and an ideal position determined from a design, and detects the irradiation area P of the light-emitting element 16*a* (Step S3). The CPU 40 serving as a pattern forming unit consecutively forms plural sets of subsequent patterns (second positional misalignment correction patterns) at a position overlapping with the detected irradiation area P in the main-scanning direction, as shown in FIG. 11 (Step S4). The CPU 40 performs the above-described positional misalignment correction process based on detection results from the detecting unit regarding detection of the subsequent plurality of second positional misalignment correction patterns (Step S5). For determining the irradiation area P of the light-emitting element 16*a*, it is acceptable to form a plurality of first positional misalignment correction patterns so that a position of the first positional misalignment correction patterns can be determined by averaging detection results of the first positional misalignment correction patterns.

As described above, when the irradiation area P is detected in advance, and the correction toner images $TMn_Y$, $TMn_C$, $TMn_M$, and $TMn_K$ (second positional misalignment correction patterns) are then formed in a size smaller than the size of the light-receiving area W of the light-receiving element 16*b* at the position overlapping with the irradiation area P, the diffused reflected light components decreases. Therefore, detection errors of the correction toner images $TMn_Y$, $TMn_C$, $TMn_M$, and $TMn_K$ in each color can be suppressed. As a result, spot misalignment hardly affects the calculation of positional misalignment by the positional misalignment correcting device. Furthermore, decrease in precision of positional misalignment correction can be prevented. Moreover, because the formation area of the second positional misalignment correction pattern is smaller than that of the first positional misalignment correction pattern, an amount of toner used to form the positional misalignment correction patterns can be reduced. As described above, the black correction toner image $TMn_K$ is little affected by the diffused reflected light components. Therefore, regarding the second positional misalignment correction pattern, it is sufficient to form at least the correction toner images $TMn_Y$, $TMn_C$, and $TMn_M$ in a size smaller than the size of the light-receiving area W of the light-receiving element 16*b*. However, in terms of reducing toner consumption, the black correction toner image $TMn_K$ is preferably formed in a size smaller the size of the light-receiving area W. A shape of the second positional misalignment correction pattern is not limited to a square, such as that shown in FIG. 10A.

Because the correction toner images $TMn_Y$, $TMn_C$, $TMn_M$, and $TMn_K$ (n=1 or 2) are to be disposed on both sides in the main-scanning direction, displacement of the optical system and the like in the exposure device 11 affects positions of the images. In particular, the second correction toner image $TM2_Y$ or the second correction toner image $TM2_C$ formed by exposure with the light reflected by one reflection surface of the polygon mirror 20, and the second correction toner image $TM2_M$ or the second correction toner image $TM2_K$ formed by exposure with the light reflected by another reflection surface of the polygon mirror 20 are formed at positions shifted from intended positions in the main-scanning direction. As a result, a plurality of the second correction toner images, for example, the cyan second correction toner image $TM2_C$ and the black second correction toner image $TM2_K$, overlap with each other, and detection cannot be successfully performed.

Figure 12:
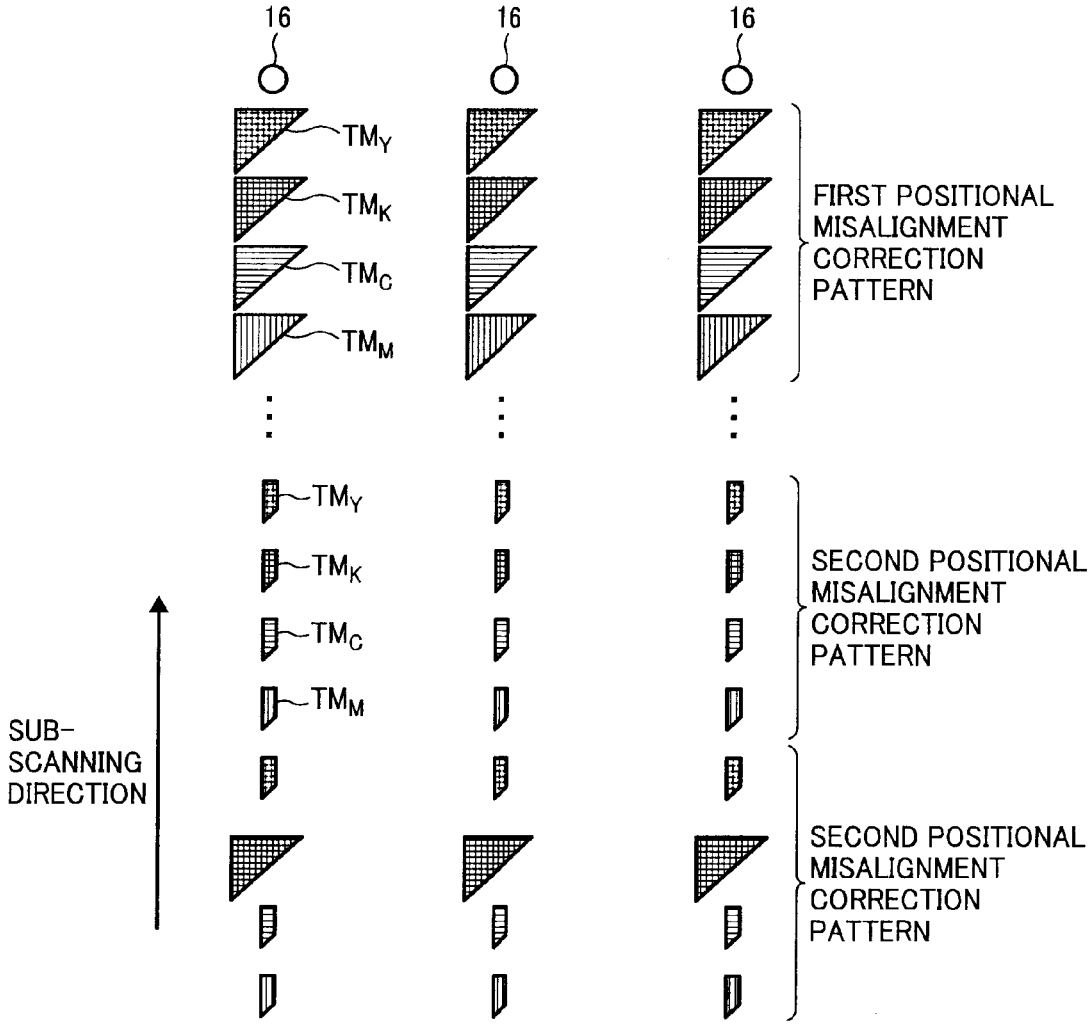
FIG. 12 is a plan view of the positional misalignment patterns of the correction toner images in another form.

To prevent a situation in which the second correction toner images $TM2_Y$, $TM2_M$, $TM2_C$, and $TM2_K$ cannot be successfully detected, a plurality of correction toner images among the second correction toner images $TM2_Y$, $TM2_C$, $TM2_M$, and $TM2_K$ and formed by exposure with the light simultaneously reflected from different reflection surfaces of the polygon mirror 20, are preferably disposed in positions at which the correction toner images do not overlap with each other even when the correction toner images are moved in parallel along the main-scanning direction. In the embodiment, the yellow second correction toner image $TM2_Y$ and the cyan second correction toner image $TM2_C$ are formed by exposure with the light reflected by one reflection surface of the polygon mirror 20, and the magenta second correction toner image $TM2_M$ and the black second correction toner image $TM2_K$ are formed by exposure with the light reflected by another reflection surface of the polygon mirror 20. For example, if the first and second correction toner images $TMn_Y$, $TMn_C$, $TMn_M$, and $TMn_K$ of each color are formed adjacent to each other in the sub-scanning direction, detection can be successfully performed because the cyan second correction toner image $TM2_C$ and the black second correction toner image $TM2_K$ do not overlap with each other even when the second correction toner image $TM2_Y$ or the second correction toner image $TM2_C$ formed by exposure with the light from one reflection surface and the second correction toner image $TM2_M$ or the second correction toner image $TM2_K$ formed by exposure with the light from another reflection surface move in the main-scanning direction. Moreover, instead of the positional misalignment correction pattern formed of two types of correction toner images, the first and the second correction toner images $TMn_Y$, $TMn_C$, $TMn_M$, and $TMn_K$, a pattern can be formed of triangular (such as a right isosceles triangle-shaped) correction toner images $TM_Y$, $TM_C$, $TM_M$, and $TM_K$ disposed in a row along the sub-scanning direction, as shown in FIG. 12. In the correction toner images $TM_Y$, $TM_C$, $TM_M$, and $TM_K$, the toner fills an area within a straight line parallel to the main-scanning direction and straight lines respectively intersecting with the main-scanning direction and the sub-scanning direction at a 45-degree angle. Therefore, for example, effects from a scratch made on the transfer belt 5 can be eliminated. In this case, however, the second positional misalignment correction pattern is preferably configured by correction toner images $TM_Y$, $TM_C$, $TM_M$, and $TM_K$ in trapezoidal, instead of triangular. The pattern of the correction toner images is formed such that an even number of groups (such as 16 groups) are aligned along the sub-scanning direction at both ends and the center in the main-scanning direction at a rate of one group per half-cycle of the photoreceptors 9Y, 9C, 9M, and 9K. The correction toner images are formed with a space of the half-cycle of the photoreceptors 9Y, 9C, 9M, and 9K therebetween to theoretically allow a median value of misalignment fluctuations to be constantly detected (an amount of fluctuation is canceled) by a pair of correction toner images $TM_Y$, $TM_C$, $TM_M$, and $TM_K$ spaced half-cycle apart being detected and averaged, under an assumption that fluctuation in the amount of positional misalignment of a single cycle of the photoreceptors 9Y, 9C, 9M, and 9K form a sine wave (refer to, for example, Japanese Patent Application Laid-open No. H11-65208).

The positional misalignment correction process is typically performed when the image forming apparatus (color laser beam printer) is turned ON or at a rate of once every several hundred printing operations, rather than at every printing operation. The process of detecting the irradiation area P can also be performed at a rate of once every several positional misalignment correction operations through use of a previous detection result, rather than being performed at each positional misalignment correction operation. Moreover, the irradiation area P can be detected in advance during manufacture of the image forming apparatus, and the detection result can be stored in a memory. The detection result stored in the memory can then be used when the position misalignment correction operation is performed. In any case, because the irradiation area P is not required to be detected, only the second positional misalignment correction pattern is required to be formed. The first positional misalignment correction pattern is not required to be formed.

Figure 13:
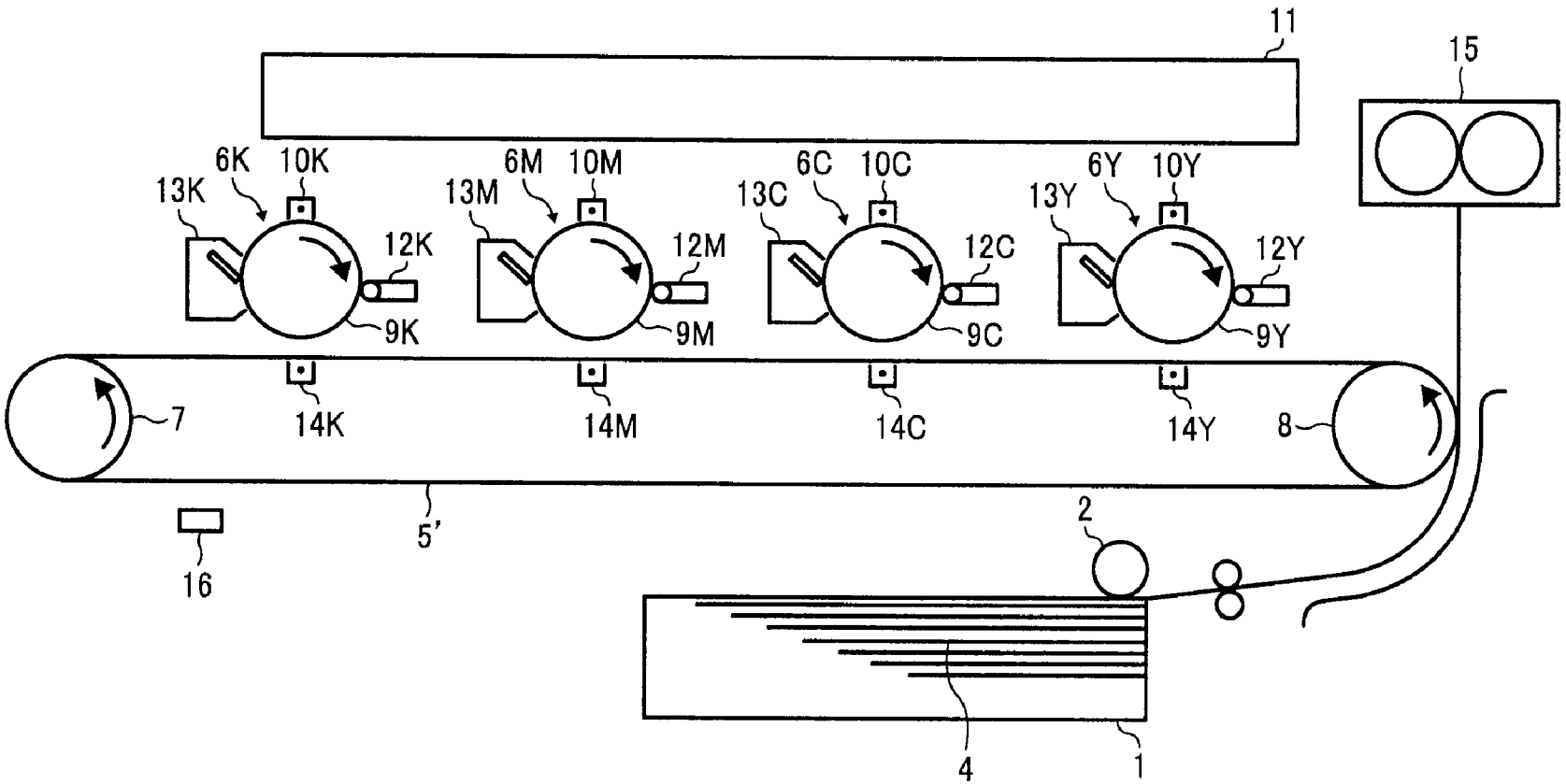
FIG. 13 is a schematic diagram of main components in an image forming apparatus according to another embodiment of the present invention.

According to the embodiment, an image forming apparatus in which the toner images are directly transferred from the image processing units 6Y, 6C, 6M, and 6K to the transfer paper 4 is given as an example. However, the present invention is not limited thereto. The technical ideas of the present invention can also be applied to an image forming apparatus in which, after all toner images are once transferred to an intermediate transfer belt 5', a secondary transfer is performed to transfer the toner images from the intermediate transfer belt 5' to the transfer paper 4, as shown in FIG. 13.

According to an aspect of the present invention, positional misalignment correction patterns can be precisely detected, while achieving an inexpensive configuration in which only a single light-receiving element is used to perform detection.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A positional misalignment correcting device for use in an image forming apparatus, the positional misalignment correcting device comprising:

a pattern forming unit that causes the image forming apparatus to form a plurality of correction patterns on a transfer member along a conveying direction of the transfer member;

a detecting unit that optically detects the correction patterns on the transfer member, wherein the detecting unit includes one light emitting element and one light receiving element, the light emitting element irradiating an irradiation area on the transfer member with a light, and the light receiving element receiving a reflection light from a light-receiving area on the transfer member; and a correcting unit that corrects positional misalignment between the correction patterns by controlling an exposing unit of the image forming apparatus based on relative positions of the correction patterns detected by the detecting unit, wherein the pattern forming unit causes the image forming apparatus to form a first correction pattern on the transfer member along the conveying direction, the detecting unit optically detects the first correction pattern on the transfer member, the pattern forming unit determines a position of the first correction pattern in a first direction perpendicular to the conveying direction based on a detection result from the detecting unit, and based on the position of the first correction pattern, causes the image forming apparatus to form a second correction pattern downstream of the first correction pattern on the transfer member such that a first formation area in which the second correction pattern is to be formed along the first direction is smaller than the light-receiving area.

2. The positional misalignment correcting device according to claim 1, wherein the first correction pattern includes a third pattern and a fourth pattern, the third pattern being stripe-shaped and parallel to the first direction, and the fourth pattern being stripe-shaped and inclined at a predetermined angle to the conveying direction, the predetermined angle being greater than 0 degrees and less than 90 degrees, and the pattern forming unit determines a position of the first correction pattern in the first direction based on detection results of the third pattern and the fourth pattern from the detecting unit.

3. The positional misalignment correcting device according to claim 1, wherein the second pattern includes a fifth pattern and a sixth pattern, the fifth pattern being stripe-shaped and parallel to the first direction, and the sixth pattern being stripe-shaped and inclined at a predetermined angle to the conveying direction, the predetermined angle being greater than 0 degrees and less than 90.

4. The positional misalignment correcting device according to claim 2, wherein the predetermined angle is 45 degrees.

5. The positional misalignment correcting device according to claim 3, wherein the predetermined angle is 45 degrees.

6. The positional misalignment correcting device according to claim 1, wherein the pattern forming unit causes the image forming apparatus to form the first correction pattern such that a formation area of the first correction pattern along the first direction is within the light-receiving area.

7. The positional misalignment correcting device according to claim 6, wherein the pattern forming unit causes the image forming apparatus to form a plurality of the first correction patterns along the conveying direction and determines a position of each of the first correction patterns in the first direction based on detection results of the first correction patterns from the detecting unit.

8. The positional misalignment correcting device according to claim 1, wherein the pattern forming unit causes the image forming apparatus to form the second correction pattern such that at least one of the first formation area, a second formation area, and a third formation area is within a range equal to or larger than the irradiation area and smaller than the light-receiving area, the second formation area being an area in which the second correction pattern is to be formed along the conveying direction, and a third formation area being an area in which the second correction pattern is to be formed along a direction perpendicular to a predetermined angle.

9. The positional misalignment correcting device according to claim 1, wherein the pattern forming unit causes the image forming apparatus to form the second correction pattern such that a center of the first formation area matches a center of the irradiation area and a shortest distance between adjacent correction patterns along the conveying direction is equal to or larger than the light-receiving area.

10. The positional misalignment correcting device according to claim 1, wherein the irradiation area and the light-receiving area are set to predetermined values in advance.

11. The positional misalignment correcting device according to claim 3, wherein the fifth pattern in the second correction pattern is square-shaped.

12. The positional misalignment correcting device according to claim 1, wherein the image forming apparatus includes a black developing unit that employs a black developer and at least one color developing unit that employs a color developer, and the pattern forming unit causes the image forming apparatus to form the second correction pattern by using the color developing unit.

13. An image forming apparatus comprising:

a plurality of image carriers disposed in a row along a conveying direction of a transfer medium;

an exposing unit that forms electrostatic latent images on each of the image carriers by exposing;

a plurality of developing units that develop the electrostatic latent images using developing agent to form developed images;

a conveying unit that conveys the transfer member;

a plurality of transferring units that transfer the developed images onto the transfer member; and a positional misalignment correcting device including a pattern forming unit that causes the image forming apparatus to form a plurality of correction patterns on the transfer member along the conveying direction;

a detecting unit that optically detects the correction patterns on the transfer member, wherein the detecting unit includes one light emitting element and one light receiving element, the light emitting element irradiating an irradiation area on the transfer member with a light, and the light receiving element receiving a reflection light from a light-receiving area on the transfer member; and a correcting unit that corrects positional misalignment between the correction patterns by controlling an exposing unit of the image forming apparatus based on relative positions of the correction patterns detected by the detecting unit, wherein the pattern forming unit causes the image forming apparatus to form a first correction pattern on the transfer member along the conveying direction, the detecting unit optically detects the first correction pattern on the transfer member, the pattern forming unit determines a position of the first correction pattern in a first direction perpendicular to the conveying direction based on a detection result from the detecting unit, and based on the position of the first correction pattern, causes the image forming apparatus to form a second correction pattern downstream of the first correction pattern on the transfer member such that a first formation area in which the second correction pattern is to be formed along the first direction is smaller than the light-receiving area.

* * * * *